US010134514B2

(12) United States Patent
Uesaka et al.

(10) Patent No.: US 10,134,514 B2
(45) Date of Patent: Nov. 20, 2018

(54) METHOD FOR PRODUCING GRAIN-ORIENTED ELECTRICAL STEEL SHEET

(71) Applicant: JFE STEEL CORPORATION, Chiyoda-ku, Tokyo (JP)

(72) Inventors: Masanori Uesaka, Tokyo (JP); Takeshi Imamura, Tokyo (JP); Ryuichi Suehiro, Tokyo (JP); Takayuki Fukunaga, Tokyo (JP); Toshito Takamiya, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 531 days.

(21) Appl. No.: 14/770,913

(22) PCT Filed: Feb. 24, 2014

(86) PCT No.: PCT/JP2014/054371
§ 371 (c)(1),
(2) Date: Aug. 27, 2015

(87) PCT Pub. No.: WO2014/132930
PCT Pub. Date: Sep. 4, 2014

(65) Prior Publication Data

US 2016/0012949 A1 Jan. 14, 2016

(30) Foreign Application Priority Data

Feb. 28, 2013 (JP) ..... 2013-038891

(51) Int. Cl.
*C21D 3/04* (2006.01)
*C21D 1/26* (2006.01)
(Continued)

(52) U.S. Cl.
CPC ..... *H01F 1/14775* (2013.01); *C21D 1/26* (2013.01); *C21D 3/04* (2013.01); *C21D 8/1222* (2013.01);
(Continued)

(58) Field of Classification Search
None
See application file for complete search history.

(56) References Cited

U.S. PATENT DOCUMENTS 4,898,626 A 2/1990 Shoen
2012/0131982 A1* 5/2012 Imamura ..... C21D 8/12 72/362

(Continued)

FOREIGN PATENT DOCUMENTS

DE 102011107304 1/2013
JP 63105926 5/1988

(Continued)

OTHER PUBLICATIONS

Machine translation of JP63-105926A, May 1988.*

(Continued)

*Primary Examiner* — Xiaowei Su
(74) *Attorney, Agent, or Firm* — RatnerPrestia

(57) ABSTRACT

In a method for producing a grain-oriented electrical steel sheet by hot rolling a raw steel material containing C: 0.002~0.10 mass %, Si: 2.0~8.0 mass % and Mn: 0.005~1.0 mass % to obtain a hot rolled sheet, subjecting the hot rolled sheet to a hot band annealing as required and further to one cold rolling or two or more cold rollings including an intermediate annealing therebetween to obtain a cold rolled sheet having a final sheet thickness, subjecting the cold rolled sheet to a primary recrystallization annealing combined with decarburization annealing, applying an annealing separator to the steel sheet surface and then subjecting to a (Continued)

final annealing, when rapid heating is performed at a rate of not less than 50° C./s in a range of 100~700° C. in the heating process of the primary recrystallization annealing, the steel sheet is subjected to a holding treatment at any temperature of 250~600° C. for 0.5~10 seconds 2 to 6 times to thereby obtain a grain-oriented electrical steel sheet being low in the iron loss and small in the deviation of the iron loss value.

20 Claims, 2 Drawing Sheets

(51) Int. Cl.

| | |
|---|---|
| ***C21D 9/46*** | (2006.01) |
| ***H01F 1/147*** | (2006.01) |
| ***C22C 38/04*** | (2006.01) |
| ***C22C 38/60*** | (2006.01) |
| ***H01F 1/16*** | (2006.01) |
| ***C21D 8/12*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/16*** | (2006.01) |
| ***C22C 38/34*** | (2006.01) |
| ***C22C 38/40*** | (2006.01) |
| ***H01F 41/02*** | (2006.01) |

(52) U.S. Cl.

CPC ..... *C21D 8/1233* (2013.01); *C21D 8/1255* (2013.01); *C21D 8/1261* (2013.01); *C21D 8/1266* (2013.01); *C21D 8/1272* (2013.01); *C21D 8/1283* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/16* (2013.01); *C22C 38/34* (2013.01); *C22C 38/40* (2013.01); *C22C 38/60* (2013.01); *H01F 1/16* (2013.01); *H01F 41/02* (2013.01)

(56) References Cited

U.S. PATENT DOCUMENTS

| | | | | |
|---|---|---|---|---|
| 2013/0160901 | A1 | 6/2013 | Omura | |
| 2013/0306202 | A1 * | 11/2013 | Joo | C21D 8/12 148/567 |
| 2014/0261895 | A1 | 9/2014 | Schrapers | |
| 2015/0187473 | A1 | 7/2015 | Imamura | |

FOREIGN PATENT DOCUMENTS

| | | | | |
|---|---|---|---|---|
| JP | 02077526 | | 3/1990 | |
| JP | 02301522 | | 12/1990 | |
| JP | 07062436 | | 3/1995 | |
| JP | 10130729 | | 5/1998 | |
| JP | 10152724 | | 6/1998 | |
| JP | 10298653 | | 11/1998 | |
| JP | 2003027194 | | 1/2003 | |
| JP | 2008001979 | | 1/2008 | |
| JP | WO 2011013858 | A1 * | 2/2011 | C21D 8/12 |
| WO | 2012032792 | | 3/2012 | |
| WO | 2014017589 | | 1/2014 | |

OTHER PUBLICATIONS

Chinese Office Action for Chinese Application No. 201480010454.5, dated May 3, 2016, 8 pages.

Extended European Search Report dated Feb. 11, 2016 in European Application No. 14756232.6-1362.

International Search Report for International Application No. PCT/JP2014/054371 dated May 13, 2014.

Canadian Office Action dated Oct. 12, 2016 for Canadian Application No. 2,900,111, 3 pages.

* cited by examiner

METHOD FOR PRODUCING GRAIN-ORIENTED ELECTRICAL STEEL SHEET

CROSS REFERENCE TO RELATED APPLICATIONS

This is the U.S. National Phase application of PCT International Application No. PCT/JP2014/054371, filed Feb. 24, 2014, and claims priority to Japanese Patent Application No. 2013-038891, filed Feb. 28, 2013, the disclosures of each of these application being incorporated herein by reference in their entireties for all purposes.

FIELD OF THE INVENTION

This invention relates to a method for producing a grain-oriented electrical steel sheet, and more particularly to a method for producing a grain-oriented electrical steel sheet which is low in the iron loss and small in the deviation of iron loss.

BACKGROUND OF THE INVENTION

The electrical steel sheets are soft magnetic materials widely used as iron cores for transformers, motors or the like. Among them, the grain-oriented electrical steel sheets are excellent in the magnetic properties because their crystal orientations are highly accumulated into {110}<001> orientation called as Goss orientation, so that they are mainly used as iron cores for large-size transformers or the like. In order to decrease no-load loss (energy loss) in the transformer, the iron loss is required to be low.

As a method for decreasing the iron loss in the grain-oriented electrical steel sheet, it is known that the increase of Si content, the decrease of sheet thickness, the high accumulation of crystal orientations, the application of tension to steel sheet, the smoothening of steel sheet surface, the refining of secondary recrystallized grains and so on are effective.

As a technique for refining secondary recrystallized grains among these methods is proposed a method wherein the steel sheet is subjected to a heat treatment by rapid heating in decarburization annealing or rapid heating just before decarburization annealing to improve primary recrystallized texture. For example, Patent Document 1 discloses a technique of obtaining a grain-oriented electrical steel sheet with a low iron loss wherein a cold rolled steel sheet with a final thickness is rapidly heated to a temperature of not lower than 700° C. at a rate of not less than 100° C./s in a non-oxidizing atmosphere having $P_{H2O}/P_{H2}$ of not more than 0.2 during decarburization annealing. Also, Patent Document 2 discloses a technique wherein a grain-oriented electrical steel sheet with a low iron loss is obtained by rapidly heating a steel sheet to 800-950° C. at a heating rate of not less than 100° C./s while an oxygen concentration in the atmosphere is set to not more than 500 ppm and subsequently holding the steel sheet at a temperature of 775-840° C. which is lower than the temperature after the rapid heating and further holding the steel sheet at a temperature of 815-875° C. Further, Patent Document 3 discloses a technique wherein an electrical steel sheet having excellent coating properties and magnetic properties is obtained by heating a steel sheet to not lower than 800° C. in a temperature range of not lower than 600° C. at a heating rate of not less than 95° C./s with properly controlling an atmosphere in this temperature range. In addition, Patent Document 4 discloses a technique wherein a grain-oriented electrical steel sheet with a low iron loss is obtained by limiting N content as AlN precipitates in the hot rolled steel sheet to not more than 25 ppm and heating to not lower than 700° C. at a heating rate of not less than 80° C./s during decarburization annealing.

In these techniques of improving the primary recrystallized texture by rapid heating, the temperature range for rapid heating is set to a range of from room temperature to not lower than 700° C., whereby the heating rate is defined unambiguously. Such a technical idea is attempted to improve the primary recrystallized texture by raising the temperature close to a recrystallization temperature in a short time to suppress development of γ-fiber (<111>//ND orientation), which is preferentially formed at a common heating rate, and to promote the generation of {110}<001> texture as a nucleus for secondary recrystallization. By applying these techniques are refined crystal grains after the secondary recrystallization (grains of Goss orientation) to improve the iron loss property.

PATENT DOCUMENTS

Patent Document 1: JP-A-H07-062436
Patent Document 2: JP-A-H10-298653
Patent Document 3: JP-A-2003-027194
Patent Document 4: JP-A-H10-130729

SUMMARY OF THE INVENTION

According to the inventors' knowledge, however, there is a problem that when the heating rate is made higher, the deviation of the iron loss property resulting from temperature variation inside the steel sheet during the heating becomes large. In the evaluation of iron loss before product shipment is generally used an average of iron loss values over the full width of the steel sheet, so that if the deviation of iron loss is large, the iron loss property in the whole of the steel sheet is evaluated to be low, and hence the desired effect by the rapid heating is not obtained.

The invention is made in view of the above problems inherent to the conventional techniques and is to propose a method advantageous for producing a grain-oriented electrical steel sheet, which is lower in the iron loss and smaller in the deviation of iron loss values.

The inventors have made various studies for solving the above task. As a result, it has been found that when rapid heating is performed in the heating process of the primary recrystallization annealing, the temperature inside the steel sheet can be more uniformized to provide the effect of the rapid heating over the full width of the steel sheet by performing a holding treatment held at a given temperature for a given time in a recovery temperature region plural times, while <111>/ND orientation is preferentially recovered to decrease <111>//ND orientation after the primary recrystallization and increase nuclei of Goss orientation, whereby recrystallized grains after the secondary recrystallization are further refined and a grain-oriented electrical steel sheet being low in the iron loss and small in the deviation of iron loss values can be obtained, and the invention has been accomplished.

That is, the invention includes a method for producing a grain-oriented electrical steel sheet by hot rolling a raw steel material containing C: 0.002~0.10 mass %, Si: 2.0~8.0 mass % and Mn: 0.005~1.0 mass % to obtain a hot rolled sheet, subjecting the hot rolled sheet to a hot band annealing as required and further to one cold rolling or two or more cold rollings including an intermediate annealing therebetween to obtain a cold rolled sheet having a final sheet thickness, subjecting the cold rolled sheet to primary recrystallization annealing combined with decarburization annealing, applying an annealing separator to the steel sheet surface and then subjecting to final annealing, characterized in that when rapid heating is performed at a rate of not less than 50° C./s in a region of 100~700° C. in the heating process of the primary recrystallization annealing, the steel sheet is subjected to a holding treatment at any temperature of 250~600° C. for 0.5~10 seconds 2 to 6 times.

The steel slab used in the method for producing a grain-oriented electrical steel sheet according to an embodiment of the invention is characterized by having a chemical composition comprising C: 0.002~0.10 mass %, Si: 2.0~8.0 mass %, Mn: 0.005~1.0 mass % and also comprising Al: 0.010~0.050 mass % and N: 0.003~0.020 mass %, or Al: 0.010~0.050 mass %, N: 0.003~0.020 mass %, Se: 0.003~0.030 mass %, and/or S: 0.002~0.03 mass % and the remainder being Fe and inevitable impurities.

Also, the steel slab used in the method for producing a grain-oriented electrical steel sheet according to an embodiment of the invention is characterized by having a chemical composition comprising C: 0.002~0.10 mass %, Si: 2.0~8.0 mass %, Mn: 0.005~1.0 mass % and also comprising one or two selected from Se: 0.003~0.030 mass % and S: 0.002~0.03 mass % and the remainder being Fe and inevitable impurities.

The steel slab used in the method for producing a grain-oriented electrical steel sheet according to an embodiment of the invention is characterized by having a chemical composition comprising C: 0.002~0.10 mass %, Si: 2.0~8.0 mass %, Mn: 0.005~1.0 mass % and also comprising Al: less than 0.01 mass %, N: less than 0.0050 mass %, Se: less than 0.0030 mass % and S: less than 0.0050 mass % and the remainder being Fe and inevitable impurities.

Furthermore, the steel slab used in the method for producing a grain-oriented electrical steel sheet according to an embodiment of the invention is characterized by further containing one or more selected from Ni: 0.010~1.50 mass %, Cr: 0.01~0.50 mass %, Cu: 0.01~0.50 mass %, P: 0.005~0.50 mass %, Sb: 0.005~0.50 mass %, Sn: 0.005~0.50 mass %, Bi: 0.005~0.50 mass %, Mo: 0.005~0.10 mass %, B: 0.0002~0.0025 mass %, Te: 0.0005~0.010 mass %, Nb: 0.0010~0.010 mass %, V: 0.001~0.010 mass % and Ta: 0.001~0.010 mass % in addition to the above chemical composition.

Also, the method for producing a grain-oriented electrical steel sheet according to an embodiment of the invention is characterized in that magnetic domain subdividing treatment is performed by forming grooves on the steel sheet surface in a direction intersecting with the rolling direction at any step after the cold rolling.

Moreover, the method for producing a grain-oriented electrical steel sheet according to an embodiment of the invention is characterized in that magnetic domain subdividing treatment is performed by continuously or intermittently irradiating an electron beam or a laser on the steel sheet surface coated with an insulating film in a direction intersecting with the rolling direction.

According to the invention, it is made possible to stably produce grain-oriented electrical steel sheets being low in the iron loss and small in the deviation of iron loss values by performing a plurality of the predetermined holding treatments at a temperature region causing recovery when the rapid heating is performed in the heating process of the primary recrystallization annealing.

DETAILED DESCRIPTION OF EMBODIMENTS OF THE INVENTION

Experiments building a momentum for developing the invention will be described below.

<Experiment 1>

A steel containing C: 0.065 mass %, Si: 3.4 mass % and Mn: 0.08 mass % is melted to produce a steel slab by a continuous casting method, which is reheated to a temperature of 1410° C. and hot rolled to obtain a hot rolled sheet of 2.4 mm in thickness. The hot rolled sheet is subjected to a hot band annealing at 1050° C. for 60 seconds and subsequently to a primary cold rolling to an intermediate thickness of 1.8 mm, and thereafter the sheet is subjected to an intermediate annealing at 1120° C. for 80 seconds and then warm-rolled at a temperature of 200° C. to obtain a cold rolled sheet having a final sheet thickness of 0.27 mm.

Figure 1:
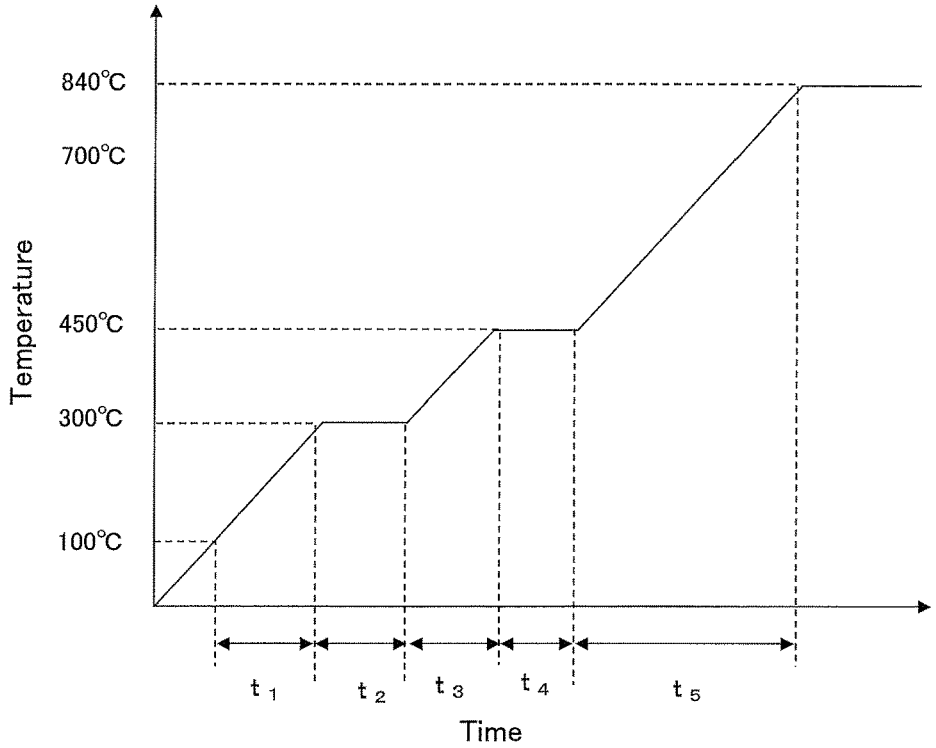
FIG. 1 is a view illustrating a heating pattern in a heating process of a primary recrystallization annealing.

Next, the cold rolled sheet is subjected to primary recrystallization annealing combined with decarburization annealing in a wet atmosphere of 50 vol % $H_2$-50 vol % $N_2$ at 840° C. for 80 seconds. In the primary recrystallization annealing, the cold rolled sheet is heated at a heating rate of 100° C./s in a region from 100° C. to 700° C. in the heating process under conditions that a holding treatment is performed for 2 seconds at a temperature from 450° C. to 700° C. on the way of the heating 1 to 7 times (No. 2~9) and that no holding treatment is performed (No. 1) as shown in Table 1. Here, the heating rate of 100° C./s means an average heating rate $((700-100)/(t_1+t_3+t_5))$ at times $t_1$, $t_3$ and $t_5$ obtained by subtracting holding time $t_2$ and $t_4$ from a time reaching from 100° C. to 700° C. when the number of the holding treatment is, for example, 2 as shown in FIG. 1 (hereinafter defined as an average heating rate in the heating time exclusive of the holding time irrespective of the number of times of holding).

Then, the steel sheet is coated on its surface with an annealing separator composed mainly of MgO, dried and subjected to final annealing including a secondary recrystallization annealing and a purification treatment of 1200° C.×7 hours in a hydrogen atmosphere to obtain a product sheet.

TABLE 1

| | Conditions of holding treatment | | | | |
|---|---|---|---|---|---|
| No. | Number of times (times) | Temperature (° C.) | Time (s) | Iron loss $W_{17/50}$ (W/kg) | Remarks |
| 1 | 0 | — | 2 | 0.878 | Comparative Example |

TABLE 1-continued

| No. | Conditions of holding treatment: Number of times (times) | Temperature (° C.) | Time (s) | Iron loss $W_{17/50}$ (W/kg) | Remarks |
|---|---|---|---|---|---|
| 2 | 1 | 400 | 2 | 0.862 | Comparative Example |
| 3 | 2 | 400, 450 | 2 | 0.853 | Invention Example |
| 4 | 3 | 350, 400, 450 | 2 | 0.849 | Invention Example |
| 5 | 4 | 350, 400, 450, 500 | 2 | 0.850 | Invention Example |
| 6 | 5 | 300, 350, 400, 450, 500 | 2 | 0.849 | Invention Example |
| 7 | 6 | 300, 350, 400, 450, 500, 550 | 2 | 0.854 | Invention Example |
| 8 | 7 | 250, 300, 350, 400, 450, 500, 550 | 2 | 0.862 | Comparative Example |
| 9 | 7 | 300, 350, 400, 450, 500, 550, 600 | 2 | 0.864 | Comparative Example |

Figure 2:
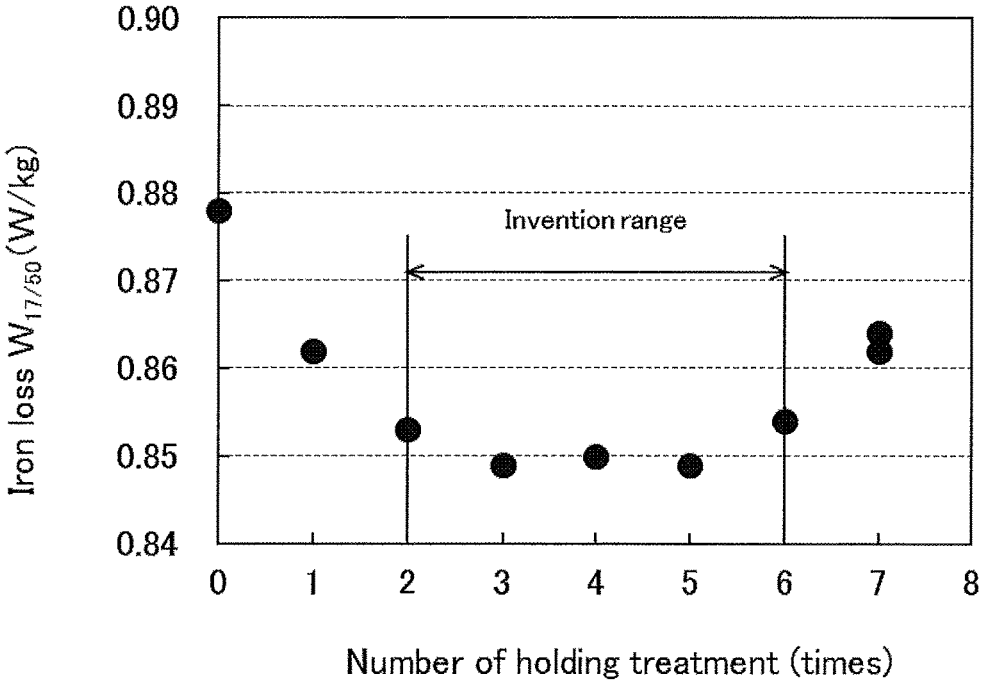
FIG. 2 is a graph showing a relation between the number of holding treatments in a heating process of a primary recrystallization annealing and iron loss $W_{17/50}$ of a product sheet.

From the product sheets thus obtained are cut out 10 specimens with 100 mm in width and 500 mm in length in the widthwise direction of the steel sheet, and their iron losses $W_{17/50}$ are measured by the method described in JIS C2556 and an average value thereof is determined. According to this method for the measurement of iron loss can be evaluated the iron loss including the deviation because the measured value is deteriorated if the deviation of iron loss is existent in the widthwise direction. The results are shown in Table 1 and in FIG. 2 as a relation between the number of the holding treatment and the iron loss. As seen from this figure, the iron loss can be substantially reduced when the holding treatment is performed 2 to 6 times on the way of the heating.

<Experiment 2>

The cold rolled sheet obtained in Experiment 1 and having a final thickness of 0.27 mm is subjected to a primary recrystallization annealing combined with decarburization annealing at 840° C. in a wet atmosphere of 50 vol % $H_2$-50 vol % $N_2$ for 80 seconds. The heating rate from 100° C. to 700° C. in the primary recrystallization annealing is set to 100° C./s and the holding treatment is performed at two temperatures shown in Table 2 for 2 seconds in a temperature region of 200~700° C. of the heating process. Among the above two holding treatments, the first treatment is performed at 450° C. and the other is conducted at an any temperature within 200~700° C.

Then, the steel sheet is coated on its surface with an annealing separator composed mainly of MgO, dried and subjected to a final annealing including a secondary recrystallization annealing and a purification treatment of 1200° C.×7 hours in a hydrogen atmosphere to obtain a product steel.

TABLE 2

| No | Conditions of holding treatment: Number of times (times) | Temperature (° C.) | Time (s) | Iron loss $W_{17/50}$ (W/kg) | Remarks |
|---|---|---|---|---|---|
| 1 | 2 | 100, 450 | 2 | 0.872 | Comparative Example |
| 2 | 2 | 150, 450 | 2 | 0.873 | Comparative Example |
| 3 | 2 | 200, 450 | 2 | 0.867 | Comparative Example |

TABLE 2-continued

| No | Conditions of holding treatment: Number of times (times) | Temperature (° C.) | Time (s) | Iron loss $W_{17/50}$ (W/kg) | Remarks |
|---|---|---|---|---|---|
| 4 | 2 | 225, 450 | 2 | 0.860 | Comparative Example |
| 5 | 2 | 250, 450 | 2 | 0.856 | Invention Example |
| 6 | 2 | 300, 450 | 2 | 0.852 | Invention Example |
| 7 | 2 | 350, 450 | 2 | 0.855 | Invention Example |
| 8 | 2 | 400, 450 | 2 | 0.853 | Invention Example |
| 9 | 2 | 425, 450 | 2 | 0.854 | Invention Example |
| 10 | 2 | 450, 475 | 2 | 0.851 | Invention Example |
| 11 | 2 | 450, 500 | 2 | 0.853 | Invention Example |
| 12 | 2 | 450, 550 | 2 | 0.854 | Invention Example |
| 13 | 2 | 450, 600 | 2 | 0.857 | Invention Example |
| 14 | 2 | 450, 625 | 2 | 0.862 | Comparative Example |
| 15 | 2 | 450, 650 | 2 | 0.872 | Comparative Example |
| 16 | 2 | 225, 300 | 2 | 0.864 | Comparative Example |
| 17 | 2 | 250, 300 | 2 | 0.855 | Invention Example |
| 18 | 2 | 300, 600 | 2 | 0.854 | Invention Example |
| 19 | 2 | 300, 625 | 2 | 0.861 | Comparative Example |
| 20 | 2 | 225, 500 | 2 | 0.862 | Comparative Example |
| 21 | 2 | 250, 500 | 2 | 0.853 | Invention Example |
| 22 | 2 | 500, 600 | 2 | 0.856 | Invention Example |
| 22 | 2 | 500, 625 | 2 | 0.862 | Comparative Example |

Figure 3:
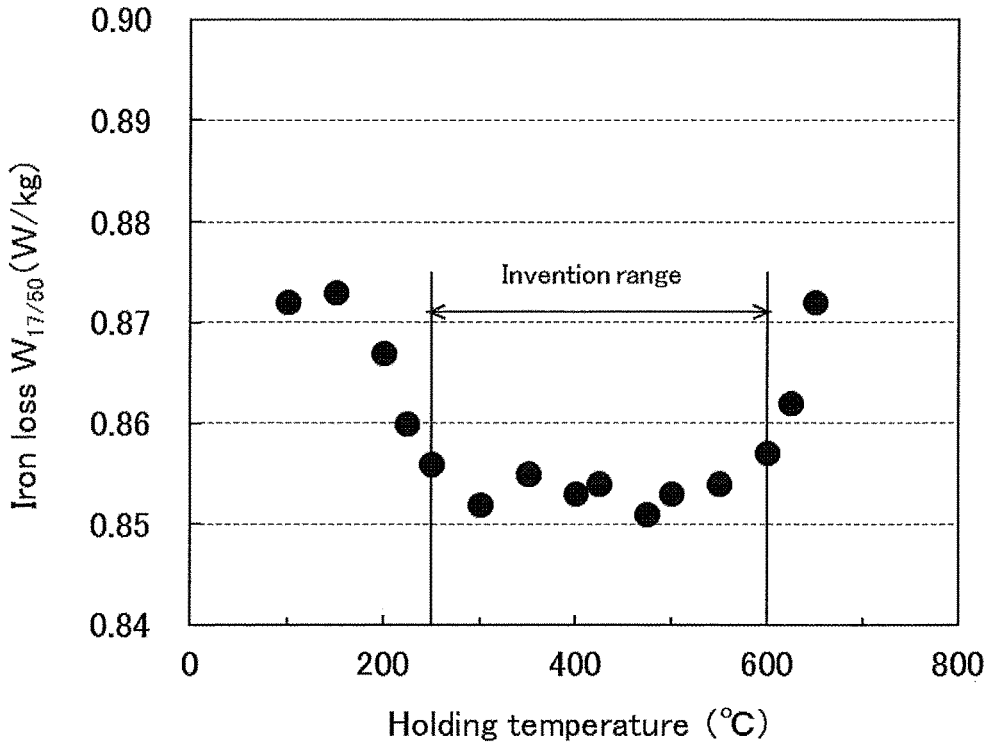
FIG. 3 is a graph showing a relation between a holding temperature in a heating process of a primary recrystallization annealing and iron loss $W_{17/50}$ of a product sheet.

From the product sheet thus obtained are cut out specimens to measure the iron loss $W_{17/50}$ by the method described in JIS C2556 as in Experiment 1. The measured results are also shown in Table 2, while the results of No. 1~15 in this table are shown in FIG. 3 as a relation between the other holding temperature other than 450° C. and the iron loss. As seen from these results, the iron loss is reduced when the other holding temperature is in a range of 250~600° C.

<Experiment 3>

The cold rolled sheet obtained in Experiment 1 and having a final sheet thickness of 0.27 mm is subjected to a primary recrystallization annealing combined with decarburization annealing in a wet atmosphere of 50 vol % $H_2$-50 vol % $N_2$ at 840° C. for 80 seconds. The heating rate from 100° C. to 700° C. in the primary recrystallization annealing is set to 100° C./s and the holding treatment is conducted for a holding time of 0.5~20 seconds as shown in Table 3 at each temperature of 450° C. and 500° C. on the way of the heating.

Then, the steel sheet is coated on its surface with an annealing separator composed mainly of MgO, dried and subjected to a final annealing including a secondary recrystallization annealing and a purification treatment of 1200° C.×7 hours in a hydrogen atmosphere to obtain a product steel.

TABLE 3

| No | Conditions of holding treatment: Number of times (times) | Temperature (° C.) | Time (s) | Iron loss $W_{17/50}$ (W/kg) | Remarks |
|---|---|---|---|---|---|
| 1 | 2 | 450, 500 | 0 | 0.879 | Comparative Example |
| 2 | 2 | 450, 500 | 0.5 | 0.859 | Invention Example |
| 3 | 2 | 450, 500 | 1 | 0.854 | Invention Example |
| 4 | 2 | 450, 500 | 2 | 0.852 | Invention Example |
| 5 | 2 | 450, 500 | 3 | 0.849 | Invention Example |
| 6 | 2 | 450, 500 | 4 | 0.855 | Invention Example |
| 7 | 2 | 450, 500 | 5 | 0.853 | Invention Example |
| 8 | 2 | 450, 500 | 7 | 0.857 | Invention Example |
| 9 | 2 | 450, 500 | 9 | 0.859 | Invention Example |
| 10 | 2 | 450, 500 | 10 | 0.859 | Invention Example |
| 11 | 2 | 450, 500 | 10.5 | 0.868 | Comparative Example |
| 12 | 2 | 450, 500 | 11 | 0.866 | Comparative Example |
| 13 | 2 | 450, 500 | 15 | 0.881 | Comparative Example |
| 14 | 2 | 450, 500 | 20 | 0.895 | Comparative Example |
| 15 | 2 | 450, 500 | 2, 5 | 0.857 | Invention Example |
| 16 | 2 | 450, 500 | 2, 15 | 0.882 | Comparative Example |
| 17 | 2 | 450, 500 | 7, 10 | 0.859 | Invention Example |
| 18 | 2 | 450, 500 | 7, 15 | 0.883 | Comparative Example |

Figure 4:
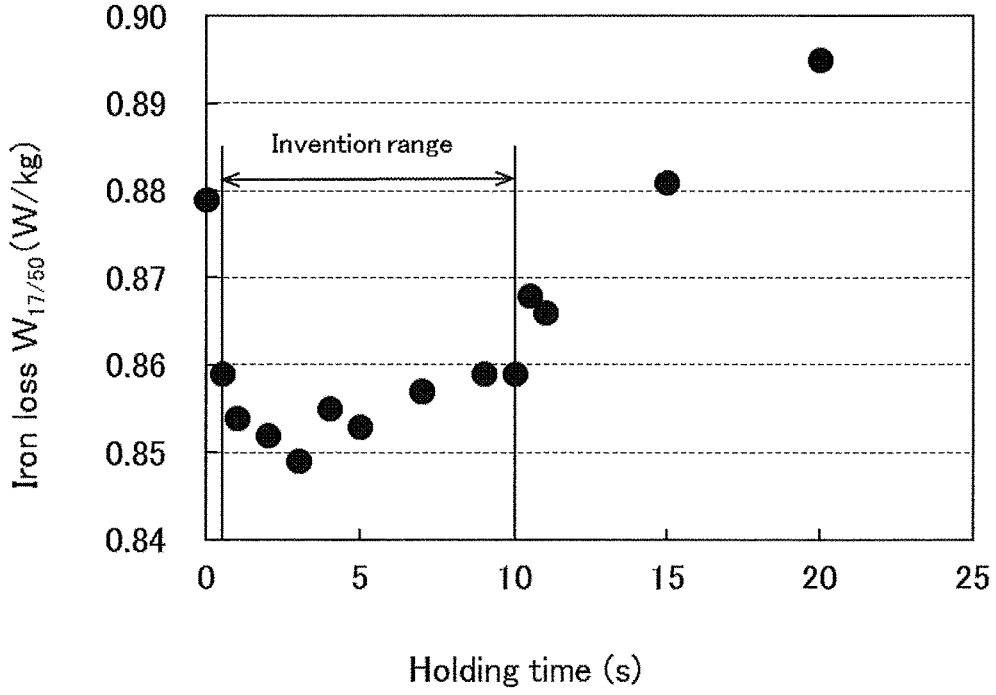
FIG. 4 is a graph showing a relation between a holding time in a heating process of a primary recrystallization annealing and iron loss $W_{17/50}$ of the product sheet.

From the product sheet thus obtained are cut out specimens to measure an iron loss $W_{17/50}$ by the method described in JIS C2556 as in Experiment 1. The measured results are also shown in Table 3, while the results of No. 1~14 in this table are shown in FIG. 4 as a relation between the holding time and the iron loss. As seen from these results, the iron loss is reduced when the holding time is in a range of 0.5~10 seconds.

As seen from the results of <Experiment 1>-<Experiment 3>, the iron loss can be reduced by performing a proper number of the holding treatment for holding in a suitable temperature range in the heating process of the primary recrystallization annealing for a suitable time. The reason thereof is not yet clear but the inventors think as follows.

The rapid heating treatment has an effect of suppressing the development of <111>//ND orientation in the recrystallization texture as previously mentioned. In general, a great deal of strain is introduced into <111>//ND orientation during the cold rolling, so that the strain energy stored is higher than those in the other orientations. Therefore, when the primary recrystallization annealing is performed at a usual heating rate, the recrystallization is preferentially caused from the rolled texture of <111>//ND orientation having a high stored strain energy.

Since grains of <111>//ND orientation are usually generated from the rolled texture of <111>//ND orientation in the recrystallization, a main orientation of the texture after the recrystallization is <111>//ND orientation. However, when the rapid heating is performed, a greater amount of heat energy is applied as compared to the energy released by recrystallization, so that the recrystallization may be caused even in other orientations having a relatively low stored strain energy, whereby the grains of <111>//ND orientation after the recrystallization are relatively decreased to improve the magnetic properties. This is a reason for performing the rapid heating in the conventional techniques.

When a holding treatment by holding at a temperature causing the recovery for a given time is performed on the way of the rapid heating, the <111>//ND orientation having a high strain energy preferentially causes the recovery. Therefore, the driving force causing the recrystallization of <111>//ND orientation resulted from the rolled texture of <111>//ND orientation is decreased selectively, and hence the recrystallization may be caused even in other orientations. As a result, the <111>//ND orientation after the recrystallization is relatively decreased further.

The reason why the iron loss can be further reduced by performing two or more holding treatments is considered due to the fact that <111>//ND orientation is decreased efficiently by conducting the holding treatments at two or more different temperatures. However, when the number of the holding treatment exceeds 6 times, the recovery is caused over a wide range and the recovered microstructure remains as it is and the expected primary recrystallized microstructure is not obtained, which is considered to largely exert a bad influence on the secondary recrystallization, leading to the deterioration of the iron loss property.

According to the above thinking, it is considered that the improvement of magnetic properties by holding at a temperature causing the recovery for a short time on the way of the heating is limited to a case that the heating rate is faster than the heating rate (10-20° C./s) using the conventional radiant tube or the like, concretely the heating rate is not less than 50° C./s. In an embodiment of the invention, therefore, the heating rate within a temperature region of 200-700° C. in the primary recrystallization annealing is defined to not less than 50° C./s.

There will be described a chemical composition of a raw steel material (slab) applied to the grain-oriented electrical steel sheet according to embodiments of the invention.

C: 0.002-0.10 mass %

When C content is less than 0.002 mass %, the effect of reinforcing grain boundary through C is lost to cause troubles in the production such as slab cracking and the like. While when it exceeds 0.10 mass %, it is difficult to decrease C content by the decarburization annealing to not more than 0.005 mass % causing no magnetic aging. Therefore, the C content is in a range of 0.002-0.10 mass %. Preferably, it is in a range of 0.010-0.080 mass %.

Si: 2.0-8.0 mass %

Si is an element required for enhancing a specific resistance of steel to reduce the iron loss. When the content is less than 2.0 mass %, the above effect is not sufficient, while when it exceeds 8.0 mass %, the workability is deteriorated and it is difficult to produce the sheet by rolling. Therefore, the Si content is in a range of 2.0-8.0 mass %. Preferably, it is in a range of 2.5-4.5 mass %.

Mn: 0.005-1.0 mass %

Mn is an element required for improving hot workability of steel. When the content is less than 0.005 mass %, the above effect is not sufficient, while when it exceeds 1.0 mass %, a magnetic flux density of a product sheet is lowered. Therefore, the Mn content is in a range of 0.005-1.0 mass %. Preferably, it is in a range of 0.02-0.20 mass %.

As to ingredients other than C, Si and Mn, in order to cause the secondary recrystallization, they are classified into a case using an inhibitor and a case using no inhibitor.

At first, when an inhibitor is used for causing the secondary recrystallization, for example, when an AlN-based inhibitor is used, Al and N are preferable to be contained in amounts of Al: 0.010-0.050 mass % and N: 0.003-0.020 mass %, respectively. When a MnS.MnSe-based inhibitor is used, it is preferable to contain the aforementioned amount of Mn and S: 0.002-0.030 mass % and/or Se: 0.003-0.030 mass %. When the addition amount of each of the respective elements is less than the lower limit, the inhibitor effect is not obtained sufficiently, while when it exceeds the upper limit, the inhibitor ingredients are retained as a non-solid solute state during the heating of the slab and hence the inhibitor effect is decreased and the satisfactory magnetic properties are not obtained. Moreover, the AlN-based inhibitor and the MnS/MnSe-based inhibitor may be used together.

On the other hand, when an inhibitor is not used for causing the secondary recrystallization, the contents of Al, N, S and Se mentioned above as an inhibitor forming ingredient are decreased as much as possible, and it is preferable to use a raw steel material containing Al: less than 0.01 mass %, N: less than 0.0050 mass %, S: less than 0.0050 mass % and Se: less than 0.0030 mass %.

The remainder other than the above ingredients in the raw steel material used in the grain-oriented electrical steel sheet is Fe and inevitable impurities.

However, one or more selected from Ni: 0.010-1.50 mass %, Cr: 0.01-0.50 mass %, Cu: 0.01-0.50 mass %, P: 0.005-0.50 mas %, Sb: 0.005-0.50 mass %, Sn: 0.005-0.50 mass %, Bi: 0.005-0.50 mass %, Mo: 0.005-0.10 mass %, B: 0.0002-0.0025 mass %, Te: 0.0005-0.010 mass %, Nb: 0.0010-0.010 mass %, V: 0.001-0.010 mass % and Ta: 0.001-0.010 mass % may be added properly for the purpose of improving the magnetic properties.

The method for producing the grain-oriented electrical steel sheet according to embodiments of the invention will be described below.

A steel having the aforementioned chemical composition is melted by a usual refining process and then may be shaped into a raw steel material (slab) by the conventionally well-known ingot making-blooming method or continuous casting method, or may be shaped into a thin cast slab having a thickness of not more than 100 mm by a direct casting method. The slab is reheated according to the usual manner, for example, to a temperature of about 1400° C. in the case of containing the inhibitor ingredients or to a temperature of not higher than 1250° C. in the case of containing no inhibitor ingredient and then subjected to hot rolling. Moreover, when the inhibitor ingredients are not contained, the slab may be subjected to hot rolling without reheating immediately after the casting. Also, the thin cast slab may be forwarded to subsequent steps with the omission of the hot rolling.

Then, the hot rolled sheet obtained by the hot-rolling may be subjected to a hot band annealing, if necessary. The temperature of the hot band annealing is preferable to be in a range of 800~1150° C. in order to obtain good magnetic properties. When it is lower than 800° C., a band structure formed by the hot rolling is retained, so that it is difficult to obtain primary recrystallized structure of uniformly sized grains and the growth of secondary recrystallized grains is obstructed. While when it exceeds 1150° C., the grain size after the hot band annealing becomes excessively coarsened, and hence it is also difficult to obtain primary recrystallized structure of uniformly sized grains. More preferably, it is in a range of 850~1100° C.

The steel sheet after the hot rolling or after the hot band annealing is subjected to a single cold rolling or two or more cold rollings including an intermediate annealing therebetween to obtain a cold rolled sheet having a final thickness. The annealing temperature of the intermediate annealing is preferable to be in a range of 900-1200° C. When it is lower than 900° C., the recrystallized gains after the intermediate annealing become finer and further Goss nuclei in the primary recrystallized structure tend to be decreased to deteriorate magnetic properties of a product sheet. While when it exceeds 1200° C., the crystal grains become excessively coarsened in a similar fashion as in the hot band annealing, and it is difficult to obtain primary recrystallized structure of uniformly sized grains. The more preferable temperature of the intermediate annealing is in a range of 950-1150° C.

Moreover, in the cold rolling for providing the final thickness (final cold rolling), it is effective to perform warm rolling by raising the steel sheet temperature to 100~300° C. or conduct one or more aging treatment at a temperature of 100~300° C. on the way of the cold rolling for improving the primary recrystallized texture and the magnetic properties.

Thereafter, the cold rolled sheet having a final thickness is subjected to a primary recrystallization annealing combined with decarburization annealing.

In particular embodiments of the invention, it is the most important to perform a holding treatment at any temperature of 250-600° C. for 0.5-10 seconds 2-6 times when the rapid heating is conducted at not less than 50° C./s in the region of 100-700° C. in the heating process of the primary recrystallization annealing. The reason why the holding treatment is conducted two or more times lies in that <1114/ND orientation is decreased efficiently by holding at two or more temperatures as previously mentioned. However, when the number of the holding treatment exceeds 6 times, the recovery is caused over a wide range and the expected primary recrystallized microstructure is hardly obtained to rather deteriorate the iron loss properties, so that the upper limit is set to 6 times. Moreover, the heating rate (not less than 50° C./s) in the range of 200~700° C. is an average heating rate in the time except for the holding time as previously mentioned. From a viewpoint of further decreasing <1114/ND after the recrystallization, the more preferable holding temperature is any temperature in a range of 300~580° C., the more preferable holding time is 0.5~7 seconds, and the more preferable number of the holding treatment is 2~4 times. Further, the more preferable heating rate is not less than 60° C./s.

Also, the holding treatment from 250° C. to 600° C. in the heating process may be conducted at any temperature of the above temperature range, but the temperature is not necessarily constant. When the temperature change is within ±10° C./s, the effect similar to the holding case can be obtained, so that the temperature may be increased or decreased within a range of ±10° C./s.

Moreover, it is effective to increase N content in steel by conducting nitriding treatment on the way of or after the primary recrystallization annealing for improving the magnetic properties, since an inhibitor effect (preventive force) by AlN is further reinforced. The N content to be increased is preferably in a range of 50~1000 massppm. When it is less than 50 massppm, the effect of the nitriding treatment is small, while when it exceeds 1000 massppm, the preventive force becomes too large and poor second recrystallization is caused.

The steel sheet subjected to the primary recrystallization annealing is then coated on its surface with an annealing separator mainly composed of MgO, dried, and further subjected to final annealing, whereby a secondary recrystallized texture highly accumulated in Goss orientation is developed and a forsterite coating is formed for purification. The temperature of the final annealing is preferable to be, not lower than 800° C. for generating secondary recrystallization and to be raised up to about 1100° C. for completing the secondary recrystallization. Moreover, it is preferable to continue heating up to a temperature of approximately 1200° C. in order to form the forsterite coating and to enhance purification.

The steel sheet after the final annealing is then subjected to washing with water, brushing, pickling or the like for removing the unreacted annealing separator attached to the surface of the steel sheet, and thereafter subjected to a flattening annealing to conduct shape correction, which is effective for reducing the iron loss. This is due to the fact that since the final annealing is usually performed in a coiled state, a wound habit is applied to the sheet and may deteriorate the properties in the measurement of the iron loss.

Further, if the steel sheets are used with a laminated state, it is effective to apply an insulation coating onto the surface of the steel sheet in the flattening annealing or before or after of the flattening annealing. Especially, it is preferable to apply a tension-imparted coating to the steel sheet as the insulation coating for the purpose of reducing the iron loss. In the formation of the tension-imparted coating, it is more preferable to adopt a method of applying the tension coating through a binder or a method of depositing an inorganic matter onto a surface layer of the steel sheet through a physical vapor deposition or a chemical vapor deposition process because these methods can form an insulation coating having an excellent adhesion property and a considerably large effect of reducing the iron loss.

In order to further reduce the iron loss, it is preferable to conduct magnetic domain subdividing treatment. As such a treating method can be used a method of forming grooves in a final product sheet as being generally performed, a method of introducing linear or dotted heat strain or impact strain through laser irradiation, electron beam irradiation or plasma irradiation, a method of forming grooves in a surface of a steel sheet cold rolled to a final thickness or a steel sheet of an intermediate step through etching.

EXAMPLES

A steel having a chemical composition shown in No. 1~17 of Table 4 is melted to obtain a steel slab by a continuous casting method, reheated to a temperature of 1380° C. and hot rolled to obtain a hot rolled sheet of 2.0 mm in thickness. The hot rolled sheet is subjected to a hot band annealing at 1030° C. for 10 seconds and cold rolled to obtain a cold rolled sheet having a final thickness of 0.27 mm.

Thereafter, the cold rolled sheet is subjected to a primary recrystallization annealing combined with decarburization annealing in a wet atmosphere of 50 vol % $H_2$-50 vol % $N_2$ at 840° C. for 60 seconds. In this case, a heating rate from 100° C. to 700° C. in the heating process up to 840° C. is set to 75° C./s, and holding treatment is conducted at two temperatures of 450° C. and 500° C. each for 2 seconds on the way of the heating.

Then, the steel sheet after the primary recrystallization annealing is coated on its surface with an annealing separator composed mainly of MgO, dried and subjected to a final annealing including secondary recrystallization annealing and purification treatment in a hydrogen atmosphere at 1220° C. for 7 hours to obtain a product sheet. The atmosphere of the final annealing is $H_2$ gas in the holding at 1220° C. for the purification treatment, and Ar gas in the heating and cooling.

TABLE 4

| | Chemical composition (mass %) | | | | | | | | Iron loss $W_{17/50}$ (W/kg) | | | |
|---|---|---|---|---|---|---|---|---|---|---|---|---|
| | | | | | | | | | Before magnetic domain subdividing treatment | After magnetic domain subdividing treatment | | |
| No | C | Si | Mn | Al | N | Se | S | Others | | Irradiation of electron beam | Groove formation | Remarks |
| 1 | 0.062 | 3.25 | 0.08 | — | — | — | — | — | 0.849 | — | 0.751 | Invention Example |
| 2 | 0.064 | 3.40 | 0.16 | 0.005 | 0.002 | — | 0.003 | — | 0.840 | — | 0.749 | Invention Example |
| 3 | 0.069 | 3.41 | 0.09 | 0.026 | 0.009 | 0.022 | 0.003 | — | 0.805 | — | 0.739 | Invention Example |
| 4 | 0.191 | 3.39 | 0.09 | — | — | — | — | — | 1.561 | — | 1.552 | Comparative Example |
| 5 | 0.066 | 0.70 | 0.16 | — | — | — | — | — | 1.017 | — | 0.988 | Comparative Example |
| 6 | 0.068 | 3.40 | 1.49 | — | — | — | — | — | 1.012 | — | 0.968 | Comparative Example |
| 7 | 0.061 | 3.25 | 0.05 | — | — | 0.024 | — | — | 0.847 | — | 0.755 | Invention Example |
| 8 | 0.041 | 3.25 | 0.06 | — | — | 0.021 | 0.004 | Sb: 0.027 | 0.836 | — | 0.746 | Invention Example |
| 9 | 0.071 | 2.99 | 0.15 | 0.006 | 0.003 | 0.015 | — | Sb: 0.028, Cu: 0.37, P: 0.021 | 0.833 | — | 0.745 | Invention Example |
| 10 | 0.035 | 3.40 | 0.15 | 0.013 | 0.008 | — | 0.003 | Ni: 0.20, Cr: 0.08, Sb: 0.013, Sn: 0.06 | 0.817 | — | 0.742 | Invention Example |
| 11 | 0.005 | 3.20 | 0.30 | 0.008 | 0.003 | — | | Bi: 0.011, Mo: 0.06, B: 0.0021 | 0.848 | — | 0.747 | Invention Example |
| 12 | 0.050 | 2.60 | 0.07 | — | — | — | 0.002 | Te: 0.0040, Nb: 0.0060 | 0.835 | 0.732 | — | Invention Example |
| 13 | 0.061 | 3.25 | 0.20 | 0.037 | 0.003 | 0.020 | 0.007 | V: 0.005, Ta: 0.006 | 0.809 | 0.721 | — | Invention Example |
| 14 | 0.087 | 3.26 | 0.07 | 0.028 | 0.012 | — | — | P: 0.31, Mo: 0.008 | 0.808 | 0.719 | — | Invention Example |
| 15 | 0.166 | 3.41 | 0.16 | 0.017 | 0.006 | 0.022 | 0.004 | — | 1.635 | 1.631 | — | Comparative Example |
| 16 | 0.055 | 0.15 | 0.21 | — | — | 0.031 | 0.022 | — | 3.662 | 3.658 | — | Comparative Example |
| 17 | 0.009 | 3.40 | 1.12 | 0.019 | 0.006 | — | — | — | 1.392 | 1.352 | — | Comparative Example |

From the product sheet thus obtained are cut out 10 specimens with a width of 100 mm and a length of 500 mm in the widthwise direction and their iron losses $W_{17/50}$ are measured by a method described in JIS C2556 to determine an average value thereof.

Further, the test specimens are subjected on their surfaces to a magnetic domain subdividing treatment by forming liner grooves in a direction perpendicular to the rolling direction or irradiating an electron beam to apply heat strain, and then the iron loss $W_{17/50}$ is measured again to determine an average value thereof.

The measured results of the iron loss $W_{17/50}$ after the final annealing and the measured results of the iron loss $W_{17/50}$ after the magnetic domain subdividing treatment are also shown in Table 4. As seen from these results, the iron loss is improved even after the final annealing under the conditions applicable to the invention, and further improved in the steel sheet subjected to the magnetic subdividing treatment.

The technique of the invention is suitable for controlling the texture of the cold rolled steel sheet and is applicable to a method for producing non-oriented electrical steel sheets.

The invention claimed is:

1. A method for producing a grain-oriented electrical steel sheet by hot rolling a raw steel material containing C: 0.002~0.10 mass %, Si: 2.0~8.0 mass % and Mn: 0.005~1.0 mass % to obtain a hot rolled sheet, subjecting the hot rolled sheet to a hot band annealing as required and further to one cold rolling or two or more cold rollings including an intermediate annealing therebetween to obtain a cold rolled sheet having a final sheet thickness, subjecting the cold rolled sheet to a primary recrystallization annealing combined with decarburization annealing, applying an annealing separator to the steel sheet surface and then subjecting to a final annealing, characterized in that rapid heating is performed at a rate of not less than 50° C./s in a range of 100~700° C. in the heating process of the primary recrystallization annealing, and the steel sheet is subjected to a holding treatment with the temperature change within ±10° C./s at any temperature of 250~600° C. for 0.5~10 seconds 2 to 6 times in the heating process of the primary recrystallization annealing.

2. The method for producing a grain-oriented electrical steel sheet according to claim 1, wherein the steel slab has a chemical composition comprising C: 0.002~0.10 mass %, Si: 2.0~8.0 mass %, Mn: 0.005~1.0 mass % and also comprising Al: 0.010~0.050 mass % and N: 0.003~0.020 mass %, or Al: 0.010~0.050 mass %, N: 0.003~0.020 mass %, Se: 0.003~0.030 mass % and/or S: 0.002~0.03 mass % and the remainder being Fe and inevitable impurities.

3. The method for producing a grain-oriented electrical steel sheet according to claim 2, wherein the steel slab contains one or more selected from the group consisting of Ni: 0.010~1.50 mass %, Cr: 0.01~0.50 mass %, Cu: 0.01~0.50 mass %, P: 0.005~0.50 mass %, Sb: 0.005~0.50 mass %, Sn: 0.005~0.50 mass %, Bi: 0.005~0.50 mass %, Mo: 0.005~0.10 mass %, B: 0.0002~0.0025 mass %, Te: 0.0005~0.010 mass %, Nb: 0.0010~0.010 mass %, V: 0.001~0.010 mass % and Ta: 0.001~0.010 mass % in addition to the above chemical composition of the steel slab.

4. The method for producing a grain-oriented electrical steel sheet according to claim 3, wherein the steel sheet is subjected at any step after the cold rolling to a magnetic domain subdividing treatment by forming grooves on the steel sheet surface in a direction intersecting with the rolling direction.

5. The method for producing a grain-oriented electrical steel sheet according to claim 3, wherein the steel sheet is subjected to a magnetic domain subdividing treatment by continuously or discontinuously irradiating an electron beam or a laser onto the steel sheet surface coated with an insulating film in a direction intersecting with the rolling direction.

6. The method for producing a grain-oriented electrical steel sheet according to claim 2, wherein the steel sheet is subjected at any step after the cold rolling to a magnetic domain subdividing treatment by forming grooves on the steel sheet surface in a direction intersecting with the rolling direction.

7. The method for producing a grain-oriented electrical steel sheet according to claim 2, wherein the steel sheet is subjected to a magnetic domain subdividing treatment by continuously or discontinuously irradiating an electron beam or a laser onto the steel sheet surface coated with an insulating film in a direction intersecting with the rolling direction.

8. The method for producing a grain-oriented electrical steel sheet according to claim 1, wherein the steel slab has a chemical composition comprising C: 0.002~0.10 mass %, Si: 2.0~8.0 mass %, Mn: 0.005~1.0 mass % and also comprising one or two selected from the group consisting of Se: 0.003~0.030 mass % and S: 0.002~0.03 mass % and the remainder being Fe and inevitable impurities.

9. The method for producing a grain-oriented electrical steel sheet according to claim 8, wherein the steel slab contains one or more selected from the group consisting of Ni: 0.010~1.50 mass %, Cr: 0.01~0.50 mass %, Cu: 0.01~0.50 mass %, P: 0.005~0.50 mass %, Sb: 0.005~0.50 mass %, Sn: 0.005~0.50 mass %, Bi: 0.005~0.50 mass %, Mo: 0.005~0.10 mass %, B: 0.0002~0.0025 mass %, Te: 0.0005~0.010 mass %, Nb: 0.0010~0.010 mass %, V: 0.001~0.010 mass % and Ta: 0.001~0.010 mass % in addition to the above chemical composition of the steel slab.

10. The method for producing a grain-oriented electrical steel sheet according to claim 1, wherein the steel slab has a chemical composition comprising C: 0.002~0.10 mass %, Si: 2.0~8.0 mass %, Mn: 0.005~1.0 mass %, Al: less than 0.01 mass %, N: less than 0.0050 mass %, Se: less than 0.0030 mass %, S: less than 0.0050 mass % and the remainder being Fe and inevitable impurities.

11. The method for producing a grain-oriented electrical steel sheet according to claim 10, wherein the steel slab contains one or more selected from the group consisting of Ni: 0.010~1.50 mass %, Cr: 0.01~0.50 mass %, Cu: 0.01~0.50 mass %, P: 0.005~0.50 mass %, Sb: 0.005~0.50 mass %, Sn: 0.005~0.50 mass %, Bi: 0.005~0.50 mass %, Mo: 0.005~0.10 mass %, B: 0.0002~0.0025 mass %, Te: 0.0005~0.010 mass %, Nb: 0.0010~0.010 mass %, V: 0.001~0.010 mass % and Ta: 0.001~0.010 mass % in addition to the above chemical composition of the steel slab.

12. The method for producing a grain-oriented electrical steel sheet according to claim 11, wherein the steel sheet is subjected at any step after the cold rolling to a magnetic domain subdividing treatment by forming grooves on the steel sheet surface in a direction intersecting with the rolling direction.

13. The method for producing a grain-oriented electrical steel sheet according to claim 11, wherein the steel sheet is subjected to a magnetic domain subdividing treatment by continuously or discontinuously irradiating an electron beam or a laser onto the steel sheet surface coated with an insulating film in a direction intersecting with the rolling direction.

14. The method for producing a grain-oriented electrical steel sheet according to claim 10, wherein the steel sheet is subjected at any step after the cold rolling to a magnetic domain subdividing treatment by forming grooves on the steel sheet surface in a direction intersecting with the rolling direction.

15. The method for producing a grain-oriented electrical steel sheet according to claim 10, wherein the steel sheet is subjected to a magnetic domain subdividing treatment by continuously or discontinuously irradiating an electron beam or a laser onto the steel sheet surface coated with an insulating film in a direction intersecting with the rolling direction.

16. The method for producing a grain-oriented electrical steel sheet according to claim 1, wherein the steel slab contains one or more selected from the group consisting of Ni: 0.010~1.50 mass %, Cr: 0.01~0.50 mass %, Cu: 0.01~0.50 mass %, P: 0.005~0.50 mass %, Sb: 0.005~0.50 mass %, Sn: 0.005~0.50 mass %, Bi: 0.005~0.50 mass %, Mo: 0.005~0.10 mass %, B: 0.0002~0.0025 mass %, Te: 0.0005~0.010 mass %, Nb: 0.0010~0.010 mass %, V: 0.001~0.010 mass % and Ta: 0.001~0.010 mass % in addition to the above chemical composition of the raw steel material.

17. The method for producing a grain-oriented electrical steel sheet according to claim 16, wherein the steel sheet is subjected at any step after the cold rolling to a magnetic domain subdividing treatment by forming grooves on the steel sheet surface in a direction intersecting with the rolling direction.

18. The method for producing a grain-oriented electrical steel sheet according to claim 16, wherein the steel sheet is subjected to a magnetic domain subdividing treatment by continuously or discontinuously irradiating an electron beam or a laser onto the steel sheet surface coated with an insulating film in a direction intersecting with the rolling direction.

19. The method for producing a grain-oriented electrical steel sheet according to claim 1, wherein the steel sheet is subjected at any step after the cold rolling to a magnetic domain subdividing treatment by forming grooves on the steel sheet surface in a direction intersecting with the rolling direction.

20. The method for producing a grain-oriented electrical steel sheet according to claim 1, wherein the steel sheet is subjected to a magnetic domain subdividing treatment by continuously or discontinuously irradiating an electron beam or a laser onto the steel sheet surface coated with an insulating film in a direction intersecting with the rolling direction.

* * * * *